US005853173A

United States Patent [19]

Murphy

[11] Patent Number: 5,853,173

[45] Date of Patent: Dec. 29, 1998

[54] NIGHT AT THE RACES BOARD GAME

[76] Inventor: Michael J. Murphy, 9 Columbia Ave., Stratford, N.J. 08084

[21] Appl. No.: 950,055

[22] Filed: Oct. 14, 1997

[51] Int. Cl.[6] ..... A63F 3/00

[52] U.S. Cl. ..... 273/246

[58] Field of Search ..... 273/242, 243, 273/244, 246

[56] References Cited

U.S. PATENT DOCUMENTS

| | | | |
|---|---|---|---|
| 3,912,273 | 10/1975 | Barlow | 273/246 |
| 4,033,587 | 7/1977 | Oliver | 273/246 |
| 4,057,254 | 11/1977 | Girres | 273/246 X |
| 4,060,246 | 11/1977 | Ward | 273/246 X |
| 4,708,348 | 11/1987 | Zaruba et al. | 273/246 |
| 5,437,459 | 8/1995 | Kirby | 273/246 |

*Primary Examiner*—William E. Stoll

[57] ABSTRACT

A night at the races board game comprised of a playing board having a plurality of slots formed therein in an oval configuration. The plurality of slots form a plurality of lanes. The plurality of slots are separated into twelve lengths. One of the twelve lengths signifies a starting point and a finishing point and being so indicated by indicia relative thereto. A plurality of playing pieces resemble a race horse. Each of the playing pieces are designated by a number. Each of the playing pieces has a flat lower portion adapted for positioning within the slots of the playing board. A plurality of action cards each detailing a move made by the plurality of playing pieces around the playing board.

4 Claims, 4 Drawing Sheets

FIG 1
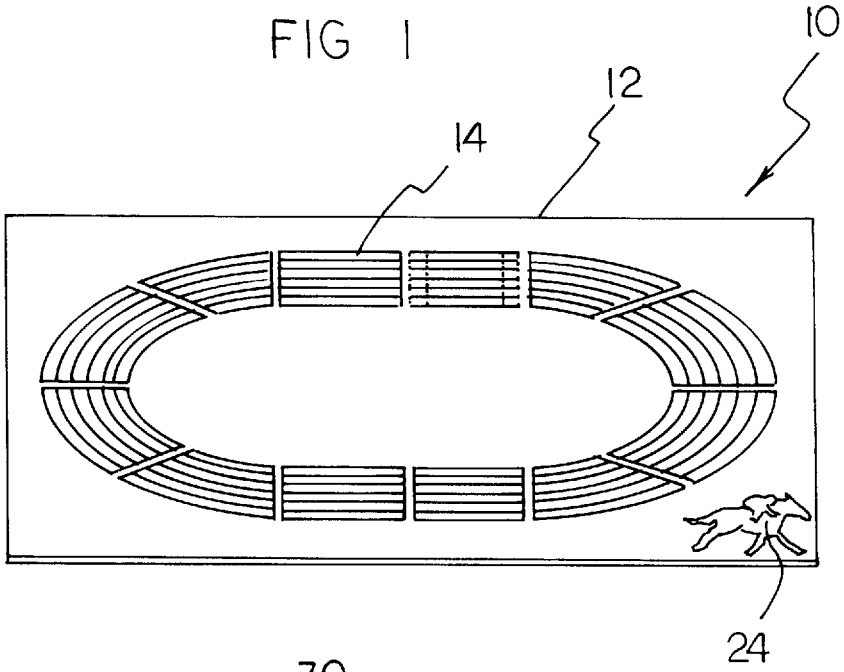
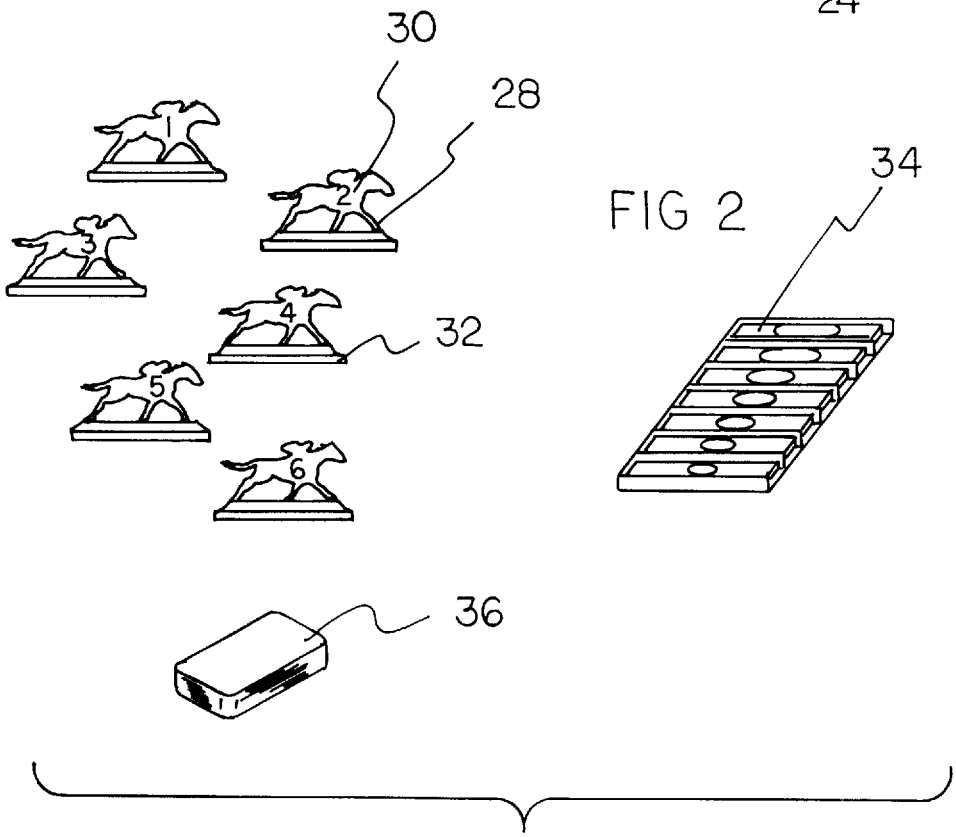
FIG 2

FIG 3
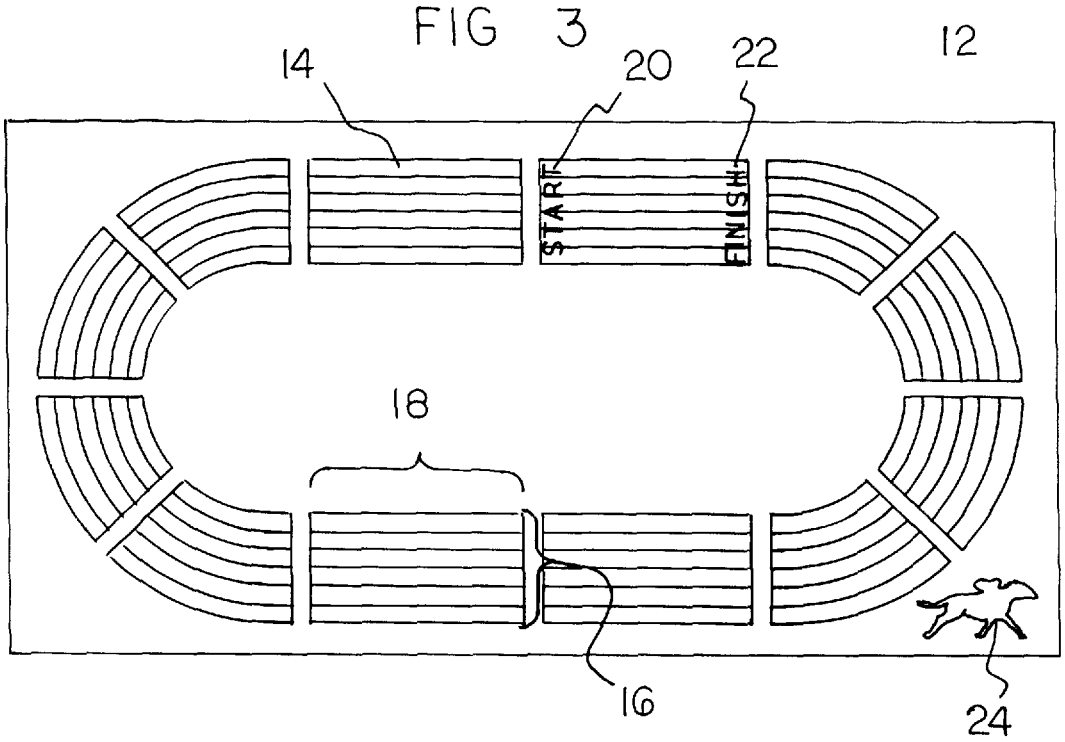
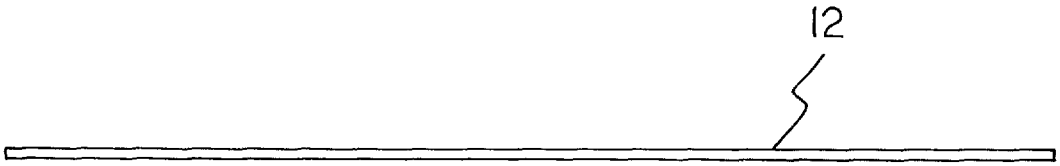
FIG 4

FIG 5
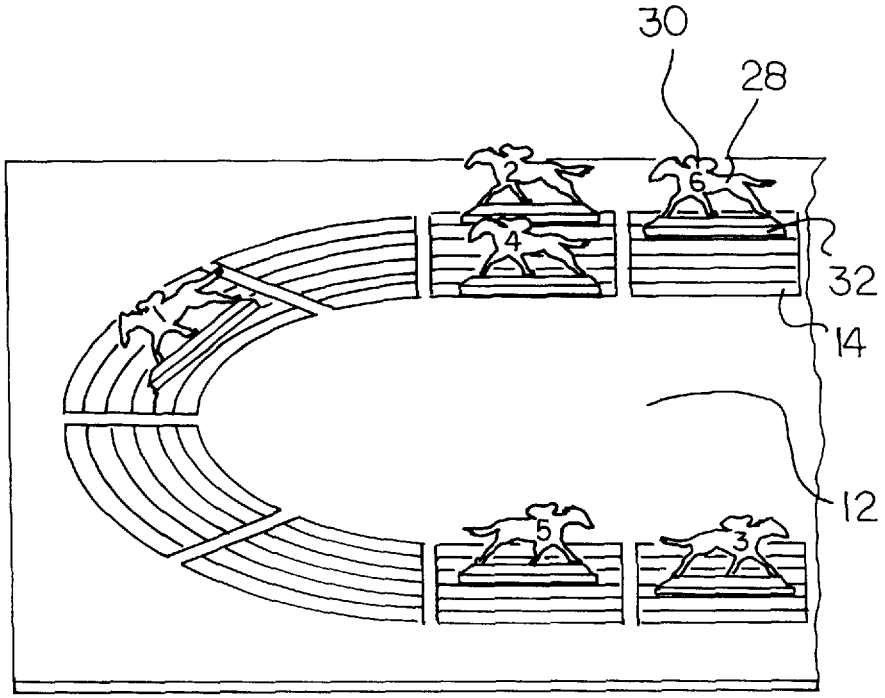
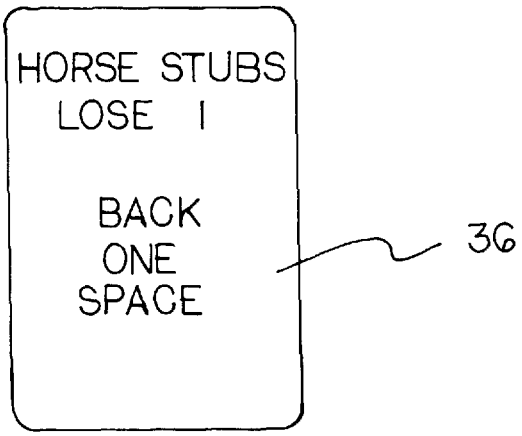
FIG 6

FIG 7
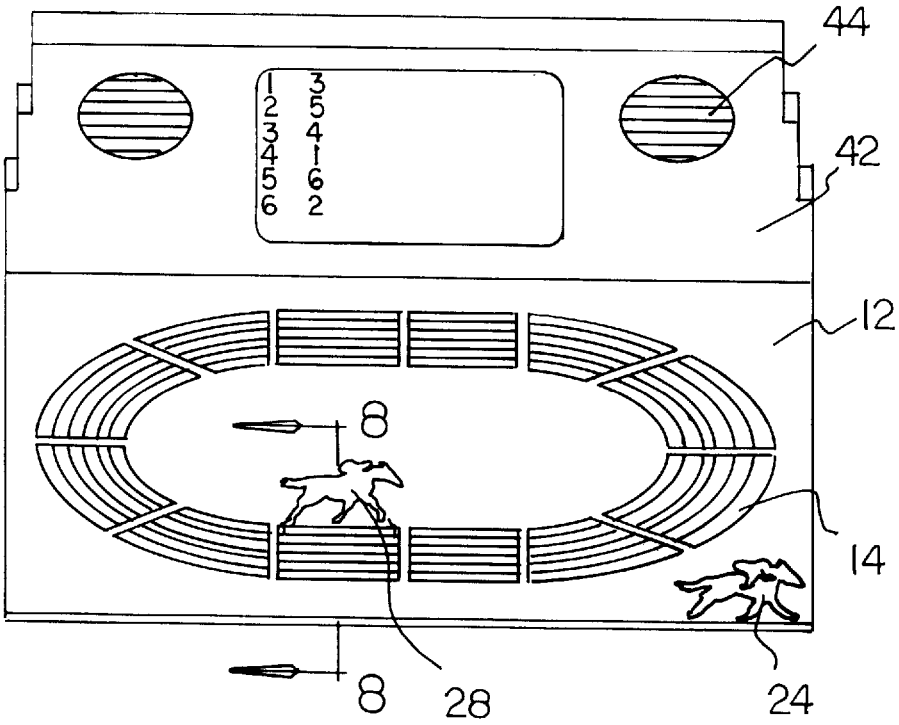
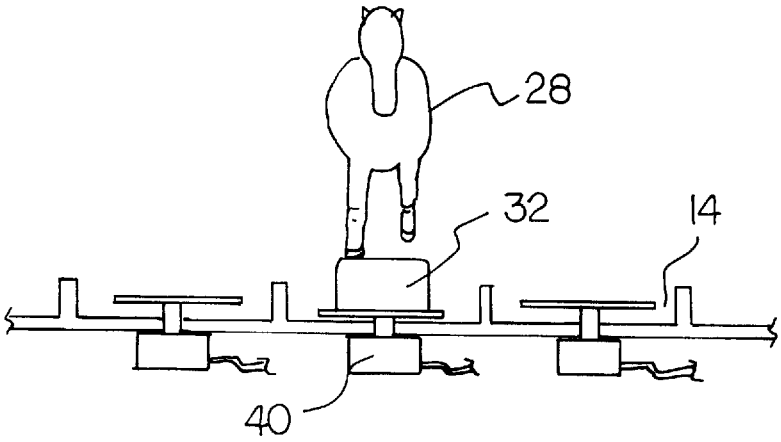
FIG 8

NIGHT AT THE RACES BOARD GAME

BACKGROUND OF THE INVENTION

1. Field of the Invention

The present invention relates to a night at the races board game and more particularly pertains to simulating horse racing in a board game format with a night at the races board game.

2. Description of the Prior Art

The use of board games is known in the prior art. More specifically, board games heretofore devised and utilized for the purpose of playing games are known to consist basically of familiar, expected and obvious structural configurations, notwithstanding the myriad of designs encompassed by the crowded prior art which have been developed for the fulfillment of countless objectives and requirements.

While these devices fulfill their respective, particular objective and requirements, the aforementioned patents do not describe a night at the races board game for simulating horse racing in a board game format.

In this respect, the night at the races board game according to the present invention substantially departs from the conventional concepts and designs of the prior art, and in doing so provides an apparatus primarily developed for the purpose of simulating horse racing a board game format.

Therefore, it can be appreciated that there exists a continuing need for new and improved night at the races board game which can be used for simulating horse racing in a board game format. In this regard, the present invention substantially fulfills this need.

SUMMARY OF THE INVENTION

In the view of the foregoing disadvantages inherent in the known types of board games now present in the prior art, the present invention provides an improved night at the races board game. As such, the general purpose of the present invention, which will be described subsequently in greater detail, is to provide a new and improved night at the races board game and method which has all the advantages of the prior art and none of the disadvantages.

To attain this, the present invention essentially comprises a playing board having a generally rectangular configuration. The playing board has a plurality of slots formed therein in an oval configuration. The plurality of slots form six lanes encircling the oval configuration. The plurality of slots are separated into twelve lengths with each of the twelve lengths comprising six lanes. One of the twelve lengths signifies a starting point and a finishing point and being so indicated by indicia relative thereto. The playing board has a racing horse inscribed on a corner thereof. The device contains six playing pieces. Each of the six playing pieces resemble a race horse. Each of the six playing pieces are designated by a number between one and six on a central portion thereof. Each of the six playing pieces has a flat lower portion adapted for positioning within the slots of the playing board. The device contains play money to be distributed among players. The device contains a plurality of action cards. Each of the action cards details a move made by the six playing pieces around the playing board.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved night at the races board game which has all the advantages of the prior art board games and none of the disadvantages.

It is another object of the present invention to provide a new and improved night at the races board game which may be easily and efficiently manufactured and marketed.

It is a further object of the present invention to provide a new and improved night at the races board game which is of durable and reliable construction.

An even further object of the present invention is to provide a new and improved night at the races board game which is susceptible of a low cost of manufacture with regard to both materials and labor, and which accordingly is then susceptible of low prices of sale to the consuming public, thereby making such a night at the races board game economically available to the buying public.

Still yet another object of the present invention is to provide a new and improved night at the races board game which provides in the apparatuses and methods of the prior art some of the advantages thereof, while simultaneously overcoming some of the disadvantages normally associated therewith.

Even still another object of the present invention is to provide a new and improved night at the races board game for simulating horse racing in a board game format.

Lastly, it is an object of the present invention to provide a new and improved night at the races board game comprised of a playing board having a plurality of slots formed therein in an oval configuration. The plurality of slots form a plurality of lanes encircling the oval configuration. The plurality of slots are separated into twelve lengths. One of the twelve lengths signifies a starting point and a finishing point and being so indicated by indicia relative thereto. A plurality of playing pieces resemble a race horse. Each of the playing pieces are designated by a number. Each of the playing pieces has a flat lower portion adapted for positioning within the slots of the playing board. A plurality of action cards each detailing a move made by the plurality of playing pieces around the playing board.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the night at the races board game constructed in accordance with the principles of the present invention.

FIG. 2 is a front view of the playing pieces, the money, and the cards of the present invention.

FIG. 3 is a plan view of the track of the present invention.

FIG. 4 is a side elevation view of the track of the present invention.

FIG. 5 is partial perspective view of the present invention illustrating the playing pieces positioned of the track.

FIG. 6 is a front view of a playing card of the present invention.

FIG. 7 is a perspective view of a second embodiment of the present invention.

FIG. 8 is a cross-sectional view as taken along line 8—8 of FIG. 7.

The same reference numerals refer to the same parts through the various Figures.

DESCRIPTION OF THE PREFERRED EMBODIMENT

With reference now to the drawings, and in particular, to FIG. 1 thereof, the preferred embodiment of the new and improved night at the races board game embodying the principles and concepts of the present invention and generally designated by the reference number 10 will be described.

Specifically, it will be noted in the various Figures that the device relates to a new and improved night at the races board game for simulating horse racing in a board game format. In its broadest context, the device consists of a playing board, six playing pieces, play money, and a plurality of action cards.

The first component of the device 10 is a playing board 12. The playing board 12 has a generally rectangular configuration. The playing board 12 has a plurality of slots 14 formed therein in an oval configuration. The oval configuration corresponds to the appearance of a race track. The plurality of slots 14 form six lanes 16. Some of the plurality of slots 14 are straight while a number of them are curved to create the oval configuration. The plurality of slots 14 are separated into twelve lengths 18 with each of the twelve lengths 18 comprising six lanes 16. One of the twelve lengths 18 signifies a starting point 20 and a finishing point 22 and being so indicated by indicia relative thereto. The playing board 12 has a racing horse 24 inscribed on a corner thereof. The number of lanes 16, as well as the number of lengths 18 could be increased or reduced.

The second component of the device 10 is six playing pieces 28. Each of the six playing pieces 28 resemble a race horse. Each of the six playing pieces 28 are designated by a number between one and six 30 on a central portion thereof. Each of the six playing pieces 28 has a flat lower portion 32 adapted for positioning within the slots 14 of the playing board 12. The number of the playing pieces 28 would vary with number of slots 14 of the playing board 12.

The third component of the device 10 is play money 34. The play money 34 is to be distributed among players. The play money 34 is used to pay to the players who place bets on the results of the game.

The fourth component of the device 10 is a plurality of action cards 36. Each of the action cards 36 details a move made by the six playing pieces 28 around the playing board 12. An example of an action card 36 denotes an action of a horse such as stumbling or pulling ahead of the pack. The action cards 36 will tell how many lengths forward or backward a particular horse will move. Each player will take turns selection the action cards 36 until one of the players playing pieces 28 crosses the finish line and is declared a winner. The players will bet the play money 34 based on odds established as to which playing piece 28 will win, which will place, and which will show.

A second embodiment of the present invention is shown in FIG. 7 and includes substantially all of the components of the present invention further including electronic sensors 40 positioned within each of the plurality of slots 14 and a corresponding metal portion secured to the flat lower portion 32 of each of the six playing pieces 28. The board game further comprises an electronic scoreboard 42 positioned orthogonally to a rear edge of the playing board 12. The electronic scoreboard 42 electrically couples to the electronic sensors 40 within each of the plurality of slots 14. Speakers 44 are secured within the electronic scoreboard 42. The electronic sensors 40 would send signals to the electronic scoreboard 42 to indicate the positioning of the six playing pieces 28 within the slots 14. The speakers 44 would be pre-programmed with crowd noises to simulate a race track. The speakers 44 could also be equipped to announce results of the race and also announce placement of the six playing pieces 28 throughout the race.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A night at the races board game for simulating horse racing in a board game format comprising, in combination:

a playing board having a generally rectagtilar configuration, the playing board having a plurality of slots formed therein in an oval configuration, the plurality of slots forming six lanes, the plurality of slot separated into twelve lengths with each of the twelve lengths comprising six lanes, one of the twelve lengths signifying a starting point and a finishing point and being so indicated by indicia thereto, the playing board having a racing horse inscribed on a comer thereof;

six playing pieces, each of the six playing pieces resembling a race horse, each of the six playing pieces designated by a number between one and six on a central portion thereof, each of the six playing pieces having a flat lower portion adapted for positioning within the slots of the playing board;

playing money to be distributed among players;

a plurality of action cards, each of the action cards detailing a move made by the six playing pieces around the playing board.

2. The board game as described in claim 1 and further including electronic sensors positioned within each of the plurality of slots and a corresponding metal portion secured to the flat lower portion of each of the six playing pieces, the board game further comprising an electronic scoreboard positioned orthogonally to a rear edge of the playing board, the electronic scoreboard electrically coupled to the electronic sensors within each of the plurality of slots.

3. The board game as described in claim 2 and further including speakers secured within the electronic scoreboard.

4. A night at the races board game for simulating horse racing in a board game format comprising, in combination:

a playing board having a plurality of slots formed therein in an oval configuration, the plurality of slots forming a plurality of lanes, the plurality of slots separated into twelve lengths, one of the twelve lengths signifying a starting point and a finishing point and being so indicated by indicia relative thereto;

a plurality of playing pieces, each of the playing pieces resembling a race horse, each of the playing pieces designated by a number, each of the playing pieces having a fiat lower portion adapted for positioning within the slots of the playing board;

a plurality of action cards, each of action cards detailing a move made by the plurality of playing pieces around the playing board.

* * * * *